US007363722B1

(12) United States Patent
Brinkmoeller

(10) Patent No.: US 7,363,722 B1
(45) Date of Patent: Apr. 29, 2008

(54) APPARATUS FOR THE TEMPORARY SUPPORT OF DIMENSIONAL LUMBER USED AS A LEDGER

(76) Inventor: David J Brinkmoeller, 1 Diellen Ct., Commack, NY (US) 11725

( * ) Notice: Subject to any disclaimer, the term of this patent is extended or adjusted under 35 U.S.C. 154(b) by 64 days.

(21) Appl. No.: 11/397,467

(22) Filed: Apr. 3, 2006

(51) Int. Cl.
*G01D 21/00* (2006.01)

(52) U.S. Cl. ..... 33/647; 33/573

(58) Field of Classification Search ..... 33/573, 33/333, 334, 533, 645, 647, 649, 568, 518
See application file for complete search history.

(56) References Cited

U.S. PATENT DOCUMENTS

| | | | | |
|---|---|---|---|---|
| 382,590 | A | 5/1888 | Clay | |
| 490,432 | A | 1/1893 | Gerhardt | |
| 646,835 | A | 4/1900 | Jackson | |
| 1,305,321 | A | 6/1919 | Tooker | |
| 2,243,468 | A * | 5/1941 | Johnson | 33/649 |
| 4,471,951 | A | 9/1984 | LeVine | |
| 4,580,769 | A | 4/1986 | Pappas | |
| 5,330,216 | A | 7/1994 | Schnell | |
| 5,402,579 | A * | 4/1995 | Smith | 33/354 |
| 5,537,805 | A * | 7/1996 | Allman | 33/518 |
| 5,722,176 | A * | 3/1998 | Hinson | 33/518 |
| 5,984,292 | A | 11/1999 | Troha | |
| 6,109,601 | A | 8/2000 | St. John, Sr. | |
| 6,367,160 | B1 * | 4/2002 | Rempe | 33/647 |
| 2001/0034952 | A1 * | 11/2001 | Mansfield | 33/647 |

FOREIGN PATENT DOCUMENTS

| | | |
|---|---|---|
| CA | 2.120.787 | 11/2005 |
| GB | 638.854 | 6/1950 |
| GB | 2.232.343 | 12/1990 |

* cited by examiner

*Primary Examiner*—Christopher W Fulton
(74) *Attorney, Agent, or Firm*—Michael I. Kroll

(57) ABSTRACT

Disclosed is an a mountable leveling support clamp comprising a mounting plate, a support arm having a horizontal and vertical portion incorporating a leveling indicator and threaded throughbore with an adjusting screw having a locking plate on one end and a handle on the other. The support clamp is designed to temporarily fix the positioning of a horizontal member to an upright as permanent fasteners are applied thereto, whereupon the support clamp is removed.

4 Claims, 8 Drawing Sheets

APPARATUS FOR THE TEMPORARY SUPPORT OF DIMENSIONAL LUMBER USED AS A LEDGER

BACKGROUND OF THE INVENTION

1. Field of the Invention

The present invention relates generally to clamps and, more specifically, to a mountable leveling support clamp comprising a mounting plate, a support arm having a horizontal and vertical portion incorporating a leveling indicator and threaded throughbore with an adjusting screw having a locking plate on one end and a handle on the other.

The support clamp is designed to temporarily fix the positioning of a horizontal member to an upright as permanent fasteners are applied thereto, whereupon the support clamp is removed.

The temporary support tool for use in construction supports a horizontal length of dimensional lumber (or ledger) that will be fastened to a vertical length of dimensional lumber or any surface requiring the use of a ledger; concrete, cinder block, drywall or plywood surfaces.

The apparatus provides a secure and level platform for the ledger to rest upon while it is in the process of being permanently attached to an upright with any acceptable and approved method: nails, screws, lags or bolts. The support is obtained by installing two temporary screws of varying length through the provided holes in the mounting plate the ledger is then held fast to the vertical member by tightening the locking plate of the apparatus by turning the threaded adjustment screw until a tight fit is made. After establishing a location where the ledger is to be fastened and establishing a level position using a leveling vial provided by the apparatus the installer will drive two temporary screws into the mounting plate. The installer will then set the ledger in place and tighten the adjusting bar, after this the installer will then proceed to make permanent attachments.

After the ledger is secured the apparatus may be removed and any additional attachment fasteners that may be required may be added.

2. Description of the Prior Art

There are other clamp devices designed for support. Typical of these is U.S. Pat. No. 382,590 issued to Clay on May 8, 1888.

Another patent was issued to Gerhardt on Jan. 24, 1893 as U.S. Pat. No. 490,432. Yet another U.S. Pat. No. 646,835 was issued to Jackson on Apr. 3, 1900 and still yet another was issued on Jun. 3, 1919 to Tooker as U.S. Pat. No. 1,305,321.

Another patent was issued to LeVine on Sep. 18, 1984 as U.S. Pat. No. 4,471,951. Yet another U.S. Pat. No. 4,580,769 was issued to Pappason Apr. 8, 1986. Another was issued to Schnell on Jul. 19, 1994 as U.S. Pat. No. 5,330,216 and still yet another was issued on Nov. 16, 1999 to Troha as U.S. Pat. No. 5,984,292.

Another patent was issued to St. John, Sr. on Aug. 29, 2000 as U.S. Pat. No. 6,109,601. Yet another U.K. Patent No. GB638,854 was issued to Brandstad on Jun. 14, 1950. Another was issued to Aldeghi on Dec. 12, 1990 as U.K. Patent No. GB2232343 and still yet another was issued on Oct. 29, 1994 to Schnell as Canadian Patent No. CA2120787.

U.S. Pat. No. 382,590

Inventor: William H. Clay

Issued: May 8, 1888

A soldering-clamp consisting of the combination of a base, 3, having a holding screw, 4,', a bifurcated standard, 5, consisting of two separated side pieces rigidly connected near their upper ends, two clamping-jaws, 6, provided, with notches 13 and grasping portions 11, and a holding device, 7, having. cross-pin '8 and thumb-screw 9, substantially as set forth.

U.S. Pat. No. 490,432

Inventor: Wilhelm Gerhardt

Issued: Jan. 24, 1893

The combination with an independent base having parallel guides and perforated as described, of a vise having a horizontal extension sliding between said guides and secured in engagement by a bolt passing through the extension and the base, substantially as set forth.

U.S. Pat. No. 646,835

Inventor: William H. Jackson

Issued: Apr. 3, 1900

An adjustable support, comprising a vertical tubular post, a rod adapted to be inserted in the upper end of the tube, and adapted to be clamped thereto, a head swiveled in the upper end of said rod, an arm pivoted to said head, collars on said tubular post and arm, a brace connecting said collars, and a slide on said arm carrying a support, substantially as described.

U.S. Pat. No. 1,305,321

Inventor: Harold A. Tooker

Issued: Jun. 3, 1919

In combination with a support, vertically spaced hooks secured to the support, a plate secured to and between the hooks, a socket secured to the plate intermediate of its ends, a horizontal rod rotatably mounted in the socket, and a vise secured to the rod.

U.S. Pat. No. 4,471,951

Inventor: Arthur L. LeVine

Issued: Sep. 18, 1984

A sharpener mounting construction for sharpening opposite sides of a knife edge including a sharpener body for clamping a knife, opposite sides on the sharpener body, bores on opposite sides of the sharpener body, a post, and a pin at the end of the post, the pin being of a diameter to fit snugly within the bores whereby the sharpener body may be mounted on the post in one attitude and thereafter the sharpener body can be inverted and mounted on the post in an inverted attitude. The posts in turn may be threadably mounted on a plate or detachably mounted on a C-clamp in a plurality of attitudes.

U.S. Pat. No. 4,580,769

Inventor: Nick Pappas

Issued: Apr. 8, 1986

A specialized clamp having a pair of spaced parallel jaw members that slide together on parallel rods orthogonally extended relative to the jaw members, there being a wall or surface mount which optionally engages and mounts the clamp either by a mounting end plate at the shank end of one of the jaws, or by sockets defined in the base into which the ends of the slide rods are inserted.

U.S. Pat. No. 5,330,216

Inventor: Marl Schnell

Issued: Jul. 19, 1994

A wall-mounted pipe clamp installation and a mounting kit therefor. The kit comprises an elongated wall bracket having its upper and bottom edges in the form of downwardly and upwardly facing and opposing channels respectively and a pair of pipe end receiving sockets slidably mountable in the bracket. Each socket has a base with exposed upper and lower edges spaced to fit in bracket supported relationship in the channels and a projecting socket formation for receiving a pipe end therein. Each socket formation is preferably provided with a set screw to secure therein the free pipe end of each pipe clamp of a pipe clamp installation.

U.S. Pat. No. 5,984,292

Inventor: Louis J. Troha

Issued: Nov. 16, 1999

An adjustable clamping device. A base or a channel is attached to either the top or side of a work table. The base has a threaded aperture for engaging one end of a threaded rod upon which several adjustable clamping bars are positioned. The clamping members are each movable to an adjusted clamping position on the threaded rod.

U.S. Pat. No. 6,109,601

Inventor: Robert W. St. John, Sr.

Issued: Aug. 29, 2000

A fishing fly tying device is provided including a C-clamp having a generally C-shaped configuration with an exterior periphery, an interior periphery, a top end, and a bottom end. The bottom end has a bolt screwably coupled thereto. Such bolt has a first end and a second end with an engagement surface capable of releasably engaging the top end of the C-clamp. A rotator is included with an end rotatably coupled to the top end of the C-clamp about an axis perpendicularly situated with respect to the bolt of the C-clamp. A bore is formed in the rotator perpendicular with respect to the axis about which the rotator rotates. The rotator is further adapted to be selectively fixed with respect to the C-clamp. A hook clamp includes a rod slidably and rotatably situated within the bore of the rotator and further adapted to be selectively fixed with respect thereto. The hook clamp is equipped with an end having a pair of spaced members for clamping a hook.

U.K. Patent Number GB638,854

Inventor: Malte Brandstad

Issued: Jun. 14, 1950

In a vice having hollow jaw-members slidably connected by a nut and clamping screw, the stationary and movable jaws 1 and 2 each comprise two trough-shaped halves of sheet-metal welded together at their abutting. edges. The clamping screw 6 is rotatable but non-displaceable axially in a bushing fixed in the wall of the jaw 2 by a washer 10 and a wear-plate 9. The nut 5 mounted on the guideway 4 in the fixed jaw 1 has machined surfaces 11 which engage with the inturned edges 12 of the slide portion 14 of the movable jaw 2. Replace-able wear strips 13 of suitable thickness, secured to the bottom of the guide-way by screws, eliminate lateral clearance between the inverted V-shaped upper part 15 of the slide portion and the correspondingly-shaped part 16 of the guide-way. The hardened steel gripping members 17, 18 are of sufficient thick-ness to prevent dehardening during the welding thereof to the jaws. The vice is bolted to a bench by a fastening plate 3 welded to the under side of the stationary jaw.

U.K. Patent Number GB 2 232 343

Inventor: Mario Aldeghi

Issued: Dec. 12, 1990

A shelf bracket has an opening in which an edge of a shelf is inserted and fixed, and includes means for adjusting the width of the opening. To this end, the bracket consists of two interengaged jaw-shaped parts 13, 14 relatively slidable perpendicularly to the surface of the shelf. The two parts are interconnected by a plurality of screws 21 which are rotatable to adjust the distance between the jaws 23, 24 of the parts.

Canadian Patent Number CA 2 120 787

Inventor: Mark Schnell

Issued: Oct. 29, 1994

A wall-mounted pipe clamp installation and a mounting kit therefor. The kit comprises an elongated wall bracket having its upper and bottom edges in the form of downwardly and upwardly facing and opposing channels respectively and a pair of pipe end receiving sockets slidably mountable in the bracket. Each socket has a base with exposed upper and lower edges spaced to fit in bracket supported relationship in the channels and a projecting socket formation for receiving a pipe end therein. Each socket formation is preferably provided with a set screw to secure therein the free pipe end of each pipe clamp of a pipe clamp installation.

While these clamping devices may be suitable for the purposes for which they were designed, they would not be as suitable for the purposes of the present invention, as hereinafter described.

SUMMARY OF THE PRESENT INVENTION

The tool is a temporary support for use in construction whereby a horizontal member, such as a ledger, is supported during fastening to an upright. Ledgers are used for many purposes in construction and require that they be installed perfectly level. Ledgers come in various lengths, widths and heights and require either making temporary supports or by having another installer give assistance for their placement. The present invention would allow a single installer to position the ledger to the upright. Although the present invention may be used alone it is preferably to be used in pairs to install a ledger with minimal time and effort. The present invention provides a mounting plate with a transverse support arm perpendicularly extending from the mounting plate forming support for the ledger with a vertically depending portion coplanar with the mounting plate and forming a 90 degree angle with the support platform portion of the support arm. Incorporated in the vertical portion of the support arm is a level indicator and an adjustment screw for moving the ledger into engagement with the upright having the apparatus temporarily mounted thereto.

A primary object of the present invention is to provide a mountable leveling support clamp having a mounting plate with a plurality of apertures passing therethrough for the placement of fasteners therein.

Another object of the present invention is to provide a mountable leveling support clamp having a support arm extending perpendicularly from said mounting plate.

Yet another object of the present invention is to provide mountable leveling support clamp wherein said support arm has a horizontal portion and a vertically depending portion.

Still yet another object of the present invention is to provide mountable leveling support clamp wherein said horizontal portion forms a platform for supporting a workpiece.

Another object of the present invention is to provide mountable leveling support clamp wherein said vertical portion of the support arm forms a 90 degree angle with the horizontal support portion and co-planar with the mounting plate.

Yet another object of the present invention is to provide mountable leveling support clamp wherein the support arm vertical portion has a level indicator mounted thereto.

Still yet another object of the present invention is to provide mountable leveling support clamp wherein the support arm vertical portion has a threaded throughbore with a threaded rod movably positioned therein having a handle at one end and a plate at the other.

Another object of the present invention is to provide a mountable leveling support clamp wherein the threaded rod provides means for applying pressure to move the supported member situated on the support arm platform into engagement with an upright as permanent fasteners are affixed thereto.

Additional objects of the present invention will appear as the description proceeds.

The present invention overcomes the shortcomings of the prior art by providing a mountable leveling support clamp comprising amounting plate, a support arm having a horizontal and vertical portion incorporating a leveling indicator and threaded throughbore with an adjusting screw having a locking plate on one end and a handle on the other.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
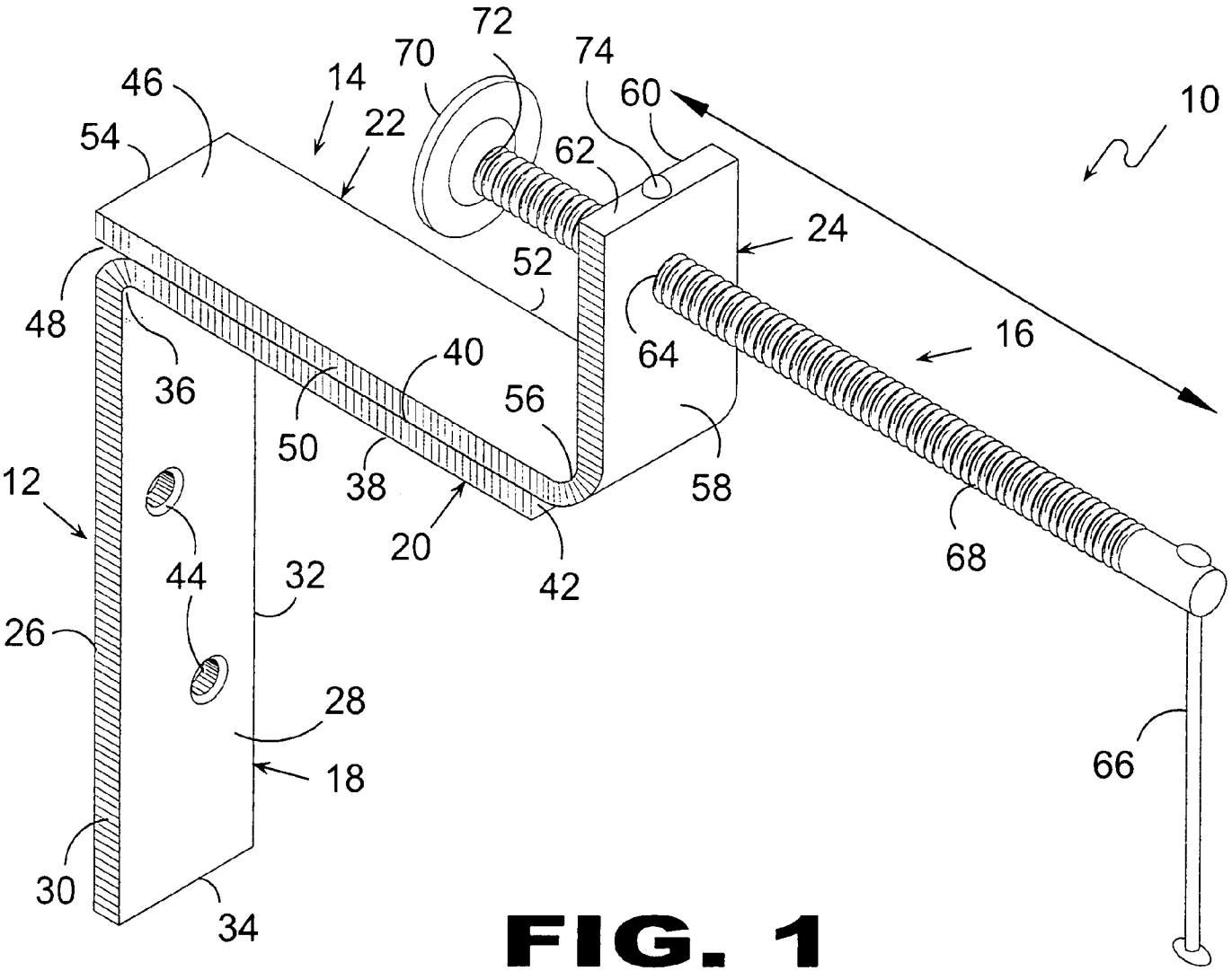
FIG. 1 is a perspective view of the mountable leveling support clamp.

Turning now descriptively to the drawings, in which similar reference characters denote similar elements throughout the several views, the Figures illustrate the Open Flotation De-inking Module for Recycled Paper of the present invention. With regard to the reference numerals used, the following numbering is used throughout the various drawing figures.

10 Apparatus for the Temporary Support of Dimensional Lumber Used as a Ledger
12 mounting member
14 arm support
16 pressure apparatus
18 leg of 12
20 leg of 12
22 arm of 14
24 arm of 14
26 back surface of 18
28 front surface of 18
30 side boundary of 12 mounting member
32 side boundary of mounting member
34 bottom edge of 18
36 angle of mounting member
38 front surface of 20
40 back surface of 20
42 terminus end of 20

44 fastener apparatuses
46 front surface of 22
48 back surface of 22
50 side boundary of 22 support arm
52 side boundary of 22 support arm
54 straight edge of 22
56 angle of angle of support arm
58 front surface of 24
60 back surface of 24
62 terminus end of 24
64 threaded bore of 24
66 handle
68 threaded shaft
70 pressure plate
72 joint
74 level
76 structure
78 ledger
80 pressure point
82 fastener

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is a perspective view of the mountable leveling support clamp. The mountable leveling support clamp 10 is comprised of mounting member 12, support arm 14 and pressure apparatus 16. mounting member has a pair of legs 18, 20 bounded by side perimeters 30, 32 preferably perpendicular forming right angle 36. Leg 18 having a front surface 28 and a back surface 26 with bores 44 passing therebetween is releasably mountable to a structure using bores 44 for fastener attachment. Leg 20 conjoined to leg 18 extending between terminus 42 and angle 36 having surfaces 38, 40 form a platform for attachment of support arm 14 comprising arms 22, 24, preferably perpendicular. Arm 22 bounded by side perimeters 50, 52 and extending between terminus straight edge 54, serving for alignment to a user provided mark on a workpiece, and angle 56, preferably a right angle has surfaces 46, 48 with surfaces 48 and 40 bonded forming an integral part. Arm 24 serves as anchor for pressure apparatus 16 having threaded bore 64 with threaded shaft 68 passing therethrough extending between pressure plate 70 and handle 66, which serves as the torque applicator. Arm 24 having front surface 58 and rear surface 60 with threaded bore 64 positioned therebetween extends between angle 56 and terminus surface 62, which incorporates level 74 positioned thereon. Pressure apparatus 16 incorporates a pressure plate 70 driven 66 by threaded shaft 68 moving in bore 64.

Figure 2:
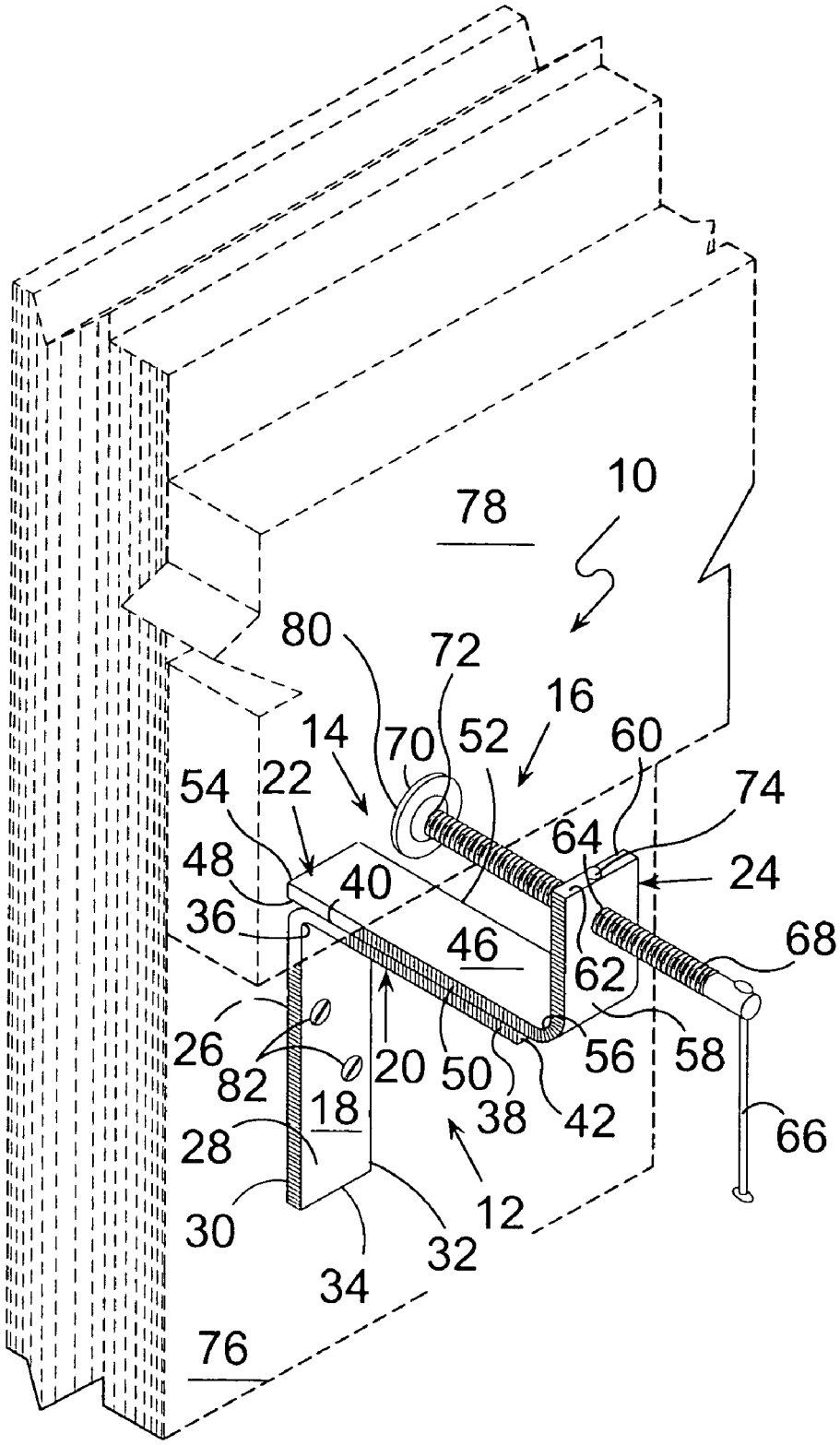
FIG. 2 is a perspective view of the mountable leveling support clamp in use.

Referring to FIG. 2, shown is a perspective view of the mountable leveling support clamp in use. The mountable leveling support clamp 10 is comprised of mounting member 12, support arm 14 and pressure apparatus 16. Mounting member has a pair of legs 18, 20 bounded by side perimeters 30, 32 preferably perpendicular forming right angle 36. Leg 18 having front surface 28 and back surface 26 with bores 44 passing therebetween is releasably mountable to structure 76 using bores 44 for fastener 82 attachment. Leg 20 conjoined to leg 18 extending between terminus 42 and angle 36 having surfaces 38, 40 form a platform for attachment of support arm 14 comprising arms 22, 24, preferably perpendicular. Arm 22 bounded by side perimeters 50, 52 and extending between terminus straight edge 54, serving for alignment to a user provided mark on a workpiece, and angle 56, preferably a right angle has surfaces 46, 48 with surfaces 48 and 40 bonded forming an integral part. Arm 24 serves as anchor for pressure apparatus 16 having threaded bore 64 with threaded shaft 68 passing therethrough extending between pressure plate 70, which is used to drive workpiece 78 into engagement with workpiece 76 while permanent fasteners are installed and handle 66, which serves as the torque applicator. Arm 24 having front surface 58 and rear surface 60 with threaded bore 64 positioned therebetween extends between angle 56 and terminus surface 62, which incorporates level 74 positioned thereon. Pressure apparatus 16 incorporates a pressure plate 70 driven 66 by threaded shaft 68 moving in bore 64.

Figure 3:
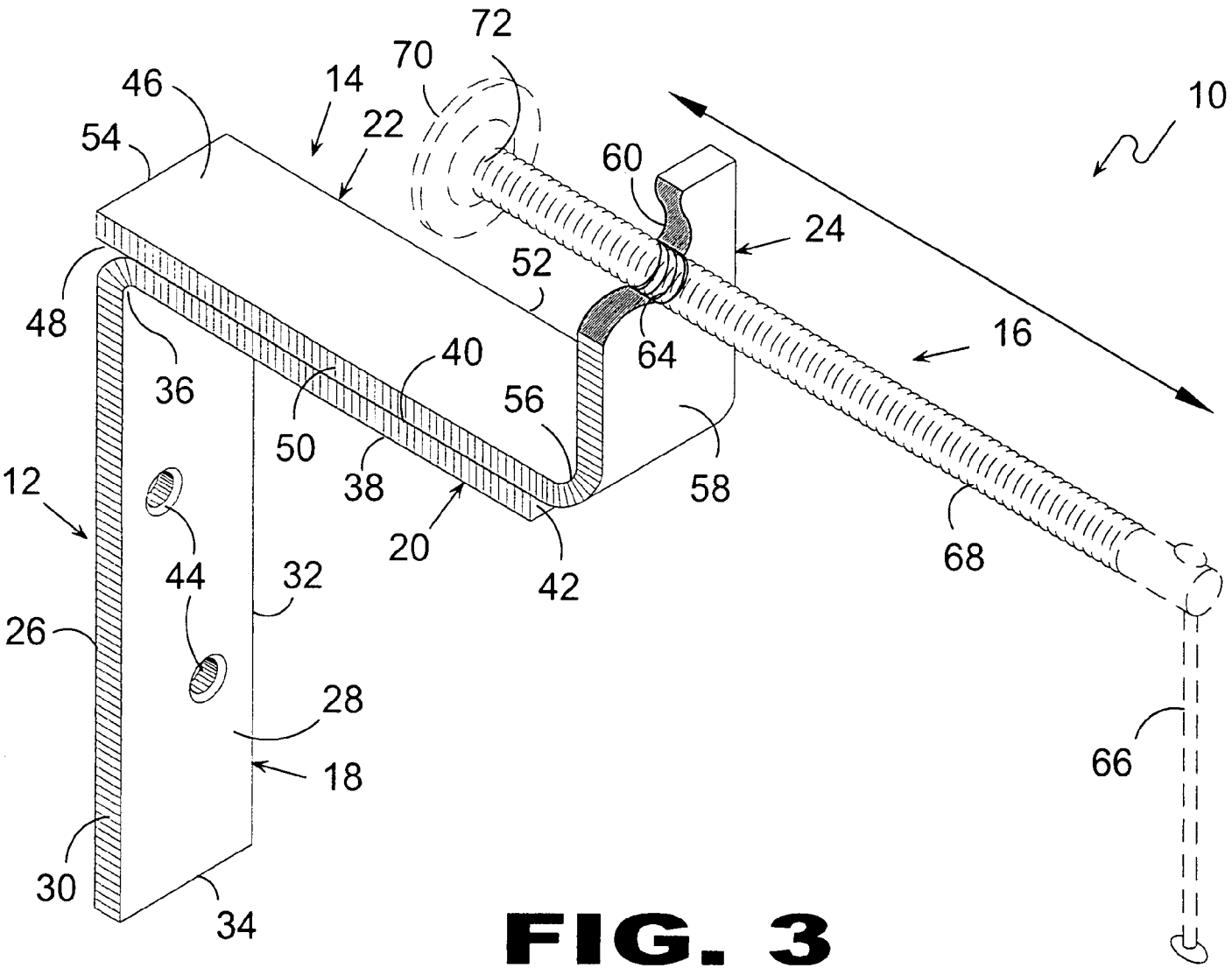
FIG. 3 is a perspective view of the mountable leveling support clamp.

Referring to FIG. 3, shown is a cutaway view of the mountable leveling support clamp. The mountable leveling support clamp 10 is comprised of mounting member 12, support arm 14 and pressure apparatus 16. mounting member has a pair of legs 18, 20 bounded by side perimeters 30, 32 preferably perpendicular forming right angle 36. Leg 18 having a front surface 28 and a back surface 26 with bores 44 passing therebetween is releasably mountable to a structure using bores 44 for fastener attachment. Leg 20 conjoined to leg 18 extending between terminus 42 and angle 36 having surfaces 38, 40 form a platform for attachment of support arm 14 comprising arms 22, 24, preferably perpendicular. Arm 22 bounded by side perimeters 50, 52 and extending between terminus straight edge 54, serving for alignment to a user provided mark on a workpiece, and angle 56, preferably a right angle has surfaces 46, 48 with surfaces 48 and 40 bonded forming an integral part. Arm 24 serves as anchor for pressure apparatus 16 having threaded bore 64 with threaded shaft 68 passing therethrough extending between pressure plate 70 and handle 66, which serves as the torque applicator. Arm 24 having front surface 58 and rear surface 60 with threaded bore 64 positioned therebetween extends between angle 56 and terminus surface 62, which incorporates level 74 positioned thereon. Pressure apparatus 16 incorporates a pressure plate 70 driven 66 by threaded shaft 68 moving in bore 64.

Figure 4:
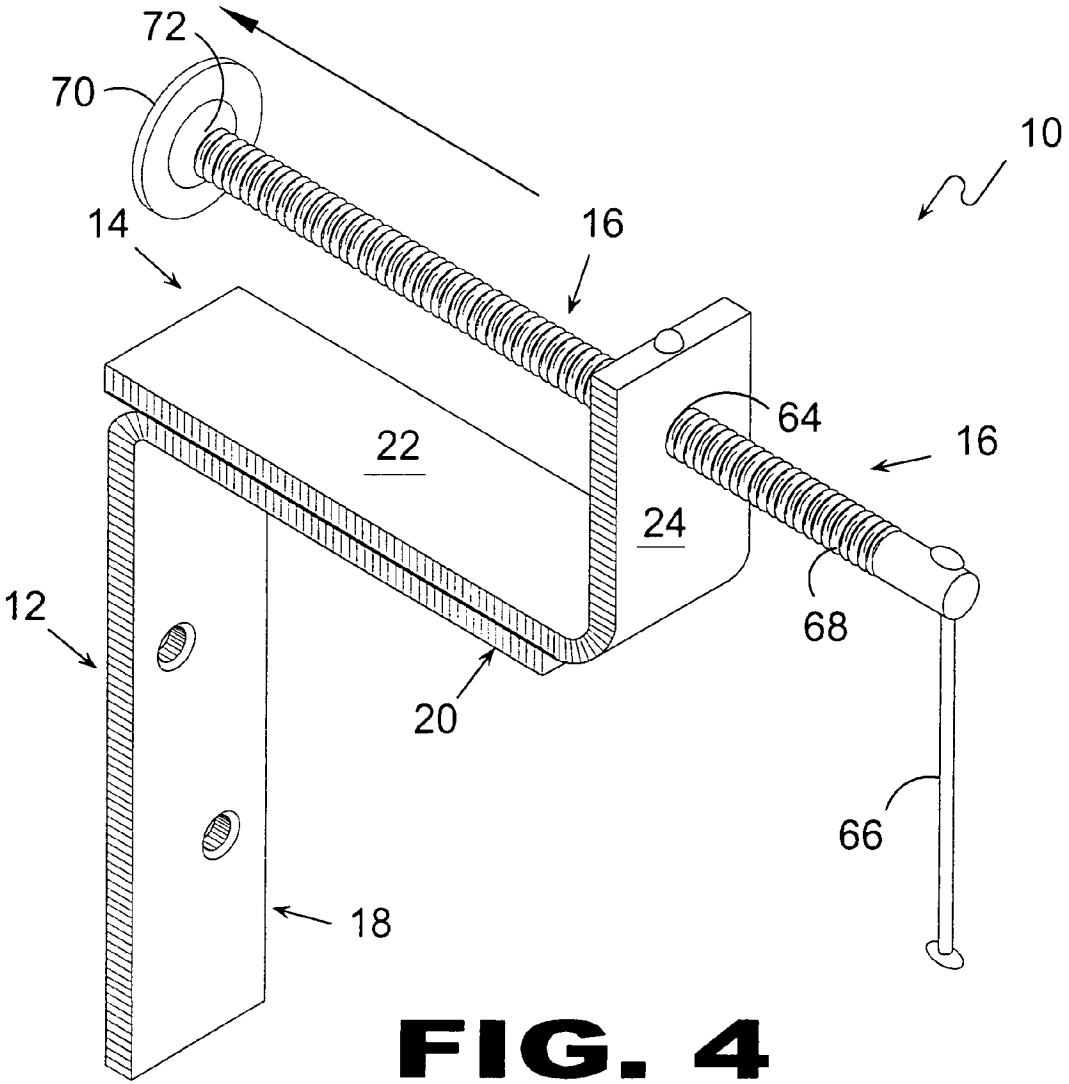
FIG. 4 is a perspective view of the mountable leveling support clamp.

Referring to FIG. 4, shown is a perspective view of the mountable leveling support clamp. The mountable leveling support clamp 10 is comprised of mounting member 12, support arm 14 and pressure apparatus 16. mounting member has a pair of legs 18, 20 bounded by side perimeters 30, 32 preferably perpendicular forming right angle 36. Leg 18 having a front surface 28 and a back surface 26 with bores 44 passing therebetween is releasably mountable to a structure using bores 44 for fastener attachment. Leg 20 conjoined to leg 18 extending between terminus 42 and angle 36 having surfaces 38, 40 form a platform for attachment of support arm 14 comprising arms 22, 24, preferably perpendicular. Arm 22 bounded by side perimeters 50, 52 and extending between terminus straight edge 54, serving for alignment to a user provided mark on a workpiece, and angle 56, preferably a right angle has surfaces 46, 48 with surfaces 48 and 40 bonded forming an integral part. Arm 24 serves as anchor for pressure apparatus 16 having threaded bore 64 with threaded shaft 68 passing therethrough extending between pressure plate 70 and handle 66, which serves as the torque applicator. Arm 24 having front surface 58 and rear surface 60 with threaded bore 64 positioned therebetween extends between angle 56 and terminus surface 62, which incorporates level 74 positioned thereon. Pressure apparatus 16 incorporates a pressure plate 70 driven 66 by threaded shaft 68 moving in bore 64.

Figure 5:
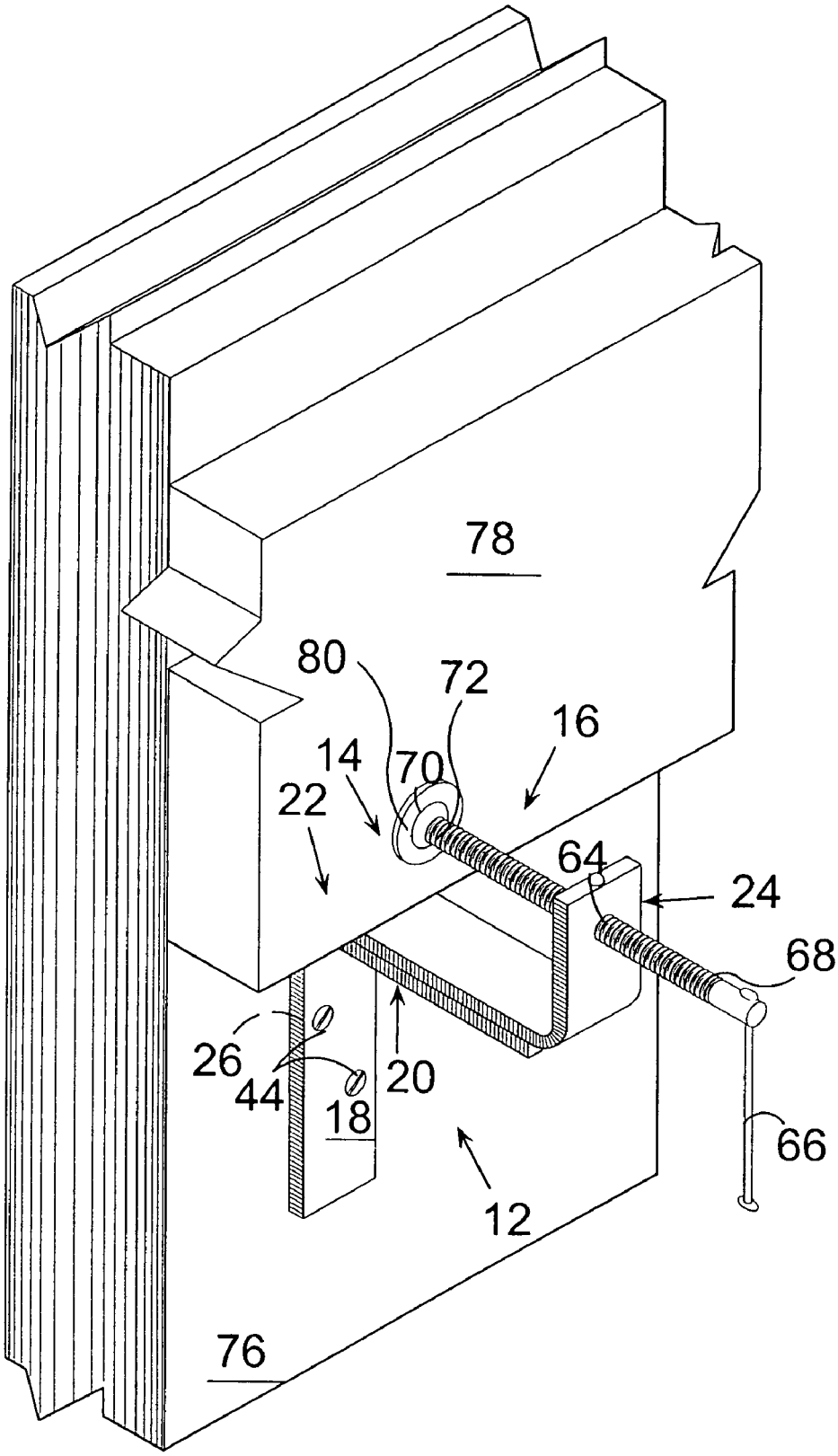
FIG. 5 is a perspective view of the present invention.

Referring to FIG. 5, shown is a perspective view of the mountable leveling support clamp in use. The mountable leveling support clamp 10 is comprised of mounting member 12, support arm 14 and pressure apparatus 16. Mounting member has a pair of legs 18, 20 bounded by side perimeters 30, 32 preferably perpendicular forming right angle 36. Leg 18 having front surface 28 and back surface 26 with bores 44 passing therebetween is releasably mountable to structure 76 using bores 44 for fastener 82 attachment. Leg 20 conjoined to leg 18 extending between terminus 42 and angle 36 having surfaces 38, 40 form a platform for attachment of support arm 14 comprising arms 22, 24, preferably perpendicular. Arm 22 bounded by side perimeters 50, 52 and extending between terminus straight edge 54, serving for alignment to a user provided mark on a workpiece, and angle 56, preferably a right angle has surfaces 46, 48 with surfaces 48 and 40 bonded forming an integral part and surface 46 supporting workpiece 78. Arm 24 serves as anchor for pressure apparatus 16 having threaded bore 64 with threaded shaft 68 passing therethrough extending between pressure plate 70, which is used to drive workpiece 78 into engagement with workpiece 76 while permanent fasteners are installed and handle 66, which serves as the torque applicator. Arm 24 having front surface 58 and rear surface 60 with threaded bore 64 positioned therebetween extends between angle 56 and terminus surface 62, which incorporates level 74 positioned thereon. Pressure apparatus 16 incorporates a pressure plate 70 driven 66 by threaded shaft 68 moving in bore 64.

Figure 6:
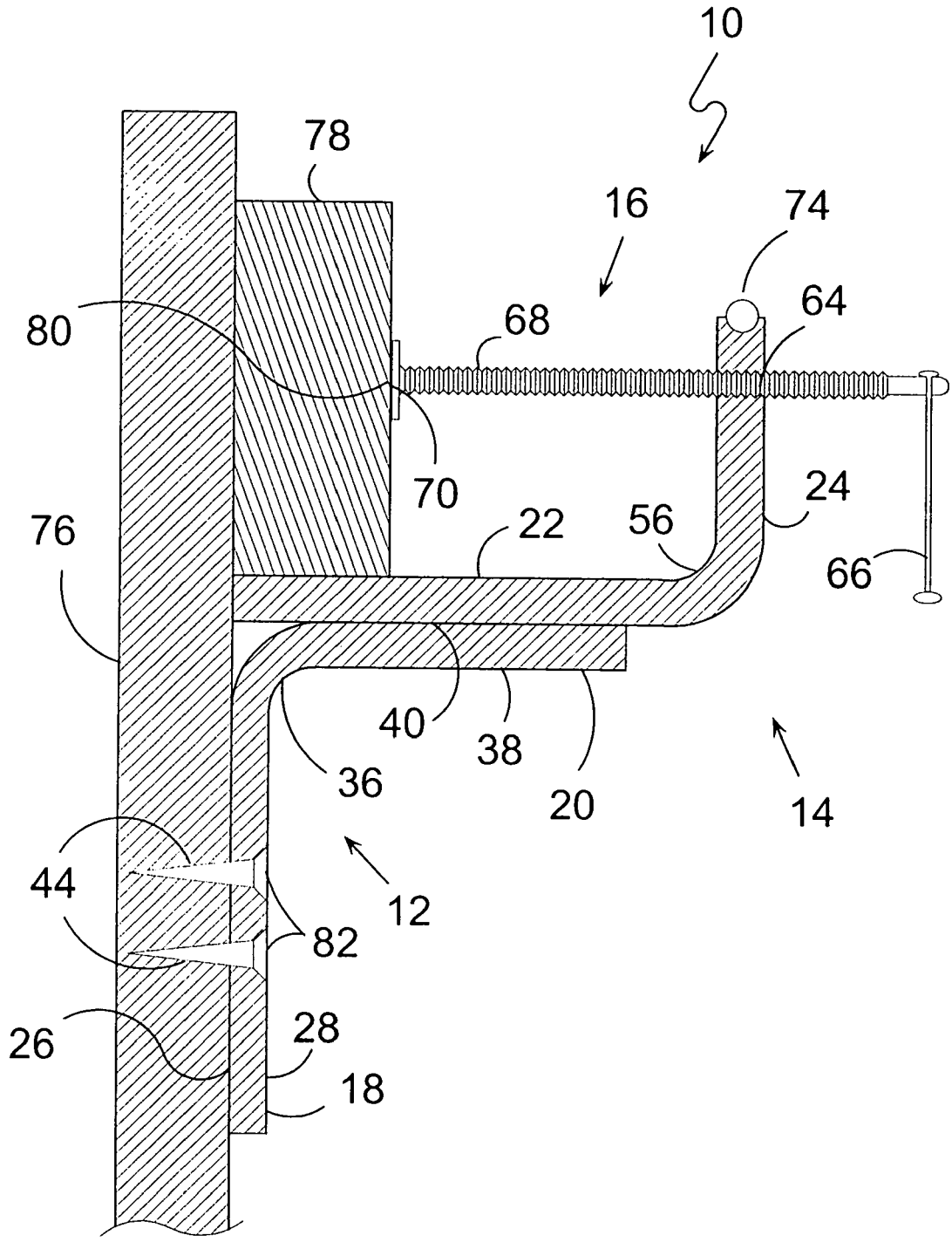
FIG. 6 is a side sectional view of the mountable leveling support clamp in use.

FIG. 6 is a side sectional view of the mountable leveling support clamp in use. The present invention is a temporary support tool 10 for use in construction whereby a horizontal length of dimensional lumber 78 (or ledger) will be fastened to a vertical length of dimensional lumber 76 or any surface which will require the use of a ledger; concrete, cinder block, drywall or plywood surfaces. The apparatus provides a secure and level platform 22 for the ledger 78 to rest upon while it is in the process of being permanently attached to an upright 76 with any acceptable and approved method: nails, screws, lags or bolts. The support is obtained by installing two temporary screws 82 of varying length through the provided holes 44 in the mounting plate 18 the ledger 78 is then held fast 80 to the vertical member 76 by tightening the locking plate 70 of the apparatus by turning 66 the threaded adjustment screw 68 until a tight fit is made. After establishing a location where the ledger 78 is to be fastened and establishing a level position using a leveling vial 74 provided by the apparatus the installer will drive two temporary screws 82 into the mounting plate 18. The installer will then set the ledger 78 in place and tighten the adjusting bar 68, after this the installer will then proceed to make permanent attachments. After the ledger is secured the apparatus may be removed and any additional attachment fasteners that may be required may be added.

Figure 7:
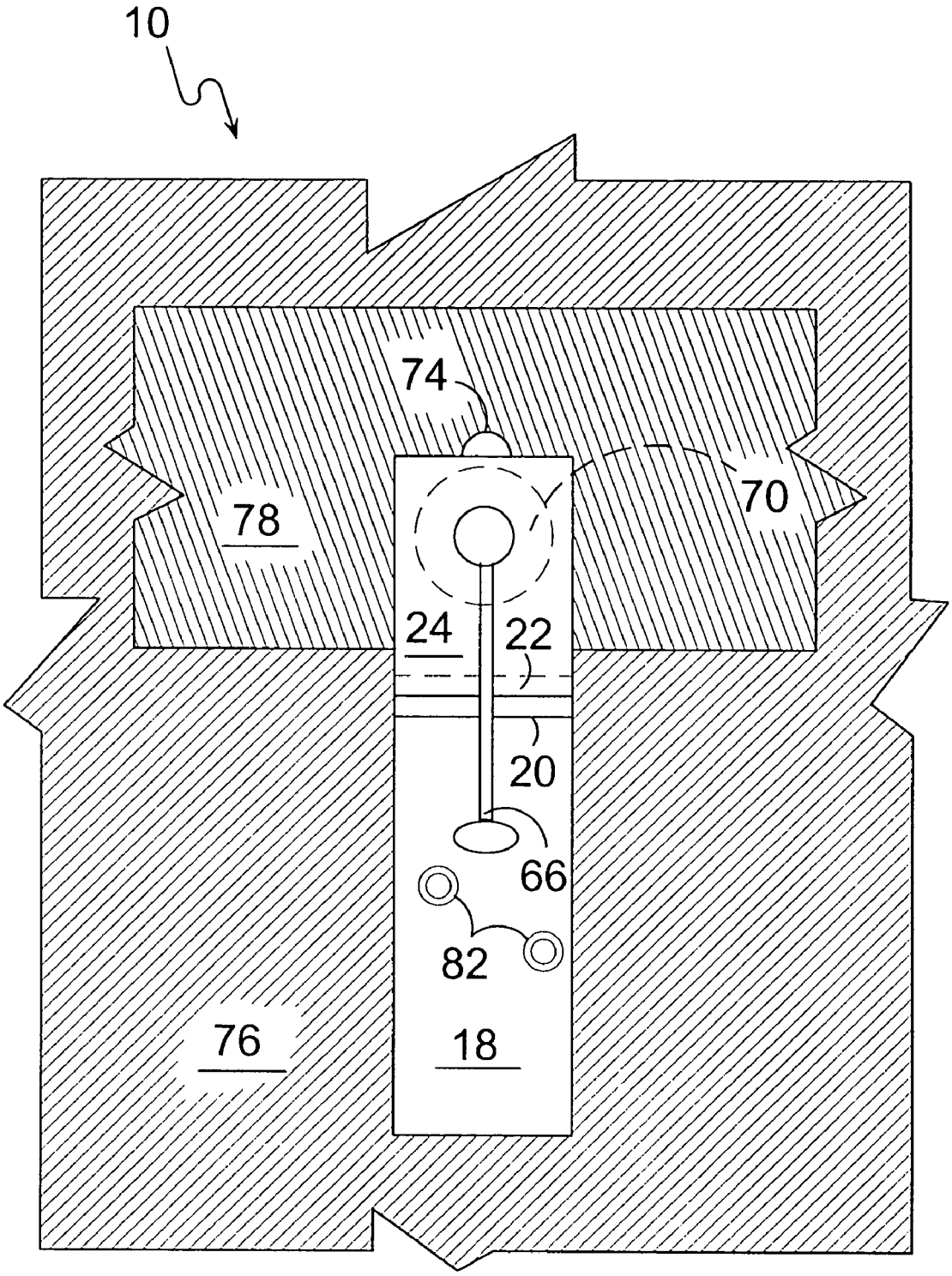
FIG. 7 is a front view of the leveling clamp in use.

FIG. 7 is a front view of the leveling clamp in use. The present invention is a temporary support tool 10 for use in construction whereby a horizontal length of dimensional lumber 78 (or ledger) will be fastened to a vertical length of dimensional lumber 76 or any surface which will require the use of a ledger; concrete, cinder block, drywall or plywood surfaces. The apparatus provides a secure and level platform 22 for the ledger 78 to rest upon while it is in the process of being permanently attached to an upright 76 with any acceptable and approved method: nails, screws, lags or bolts. The support is obtained by installing two temporary screws 82 of varying length through the provided holes 44 in the mounting plate 18 the ledger 78 is then held fast 80 to the vertical member 76 by tightening the locking plate 70 of the apparatus by turning 66 the threaded adjustment screw 68 until a tight fit is made. After establishing a location where the ledger 78 is to be fastened and establishing a level position using a leveling vial 74 provided by the apparatus the installer will drive two temporary screws 82 into the mounting plate 18. The installer will then set the ledger 78 in place and tighten the adjusting bar 68, after this the installer will then proceed to make permanent attachments. After the ledger is secured the apparatus may be removed and any additional attachment fasteners that may be required may be added.

Figure 8:
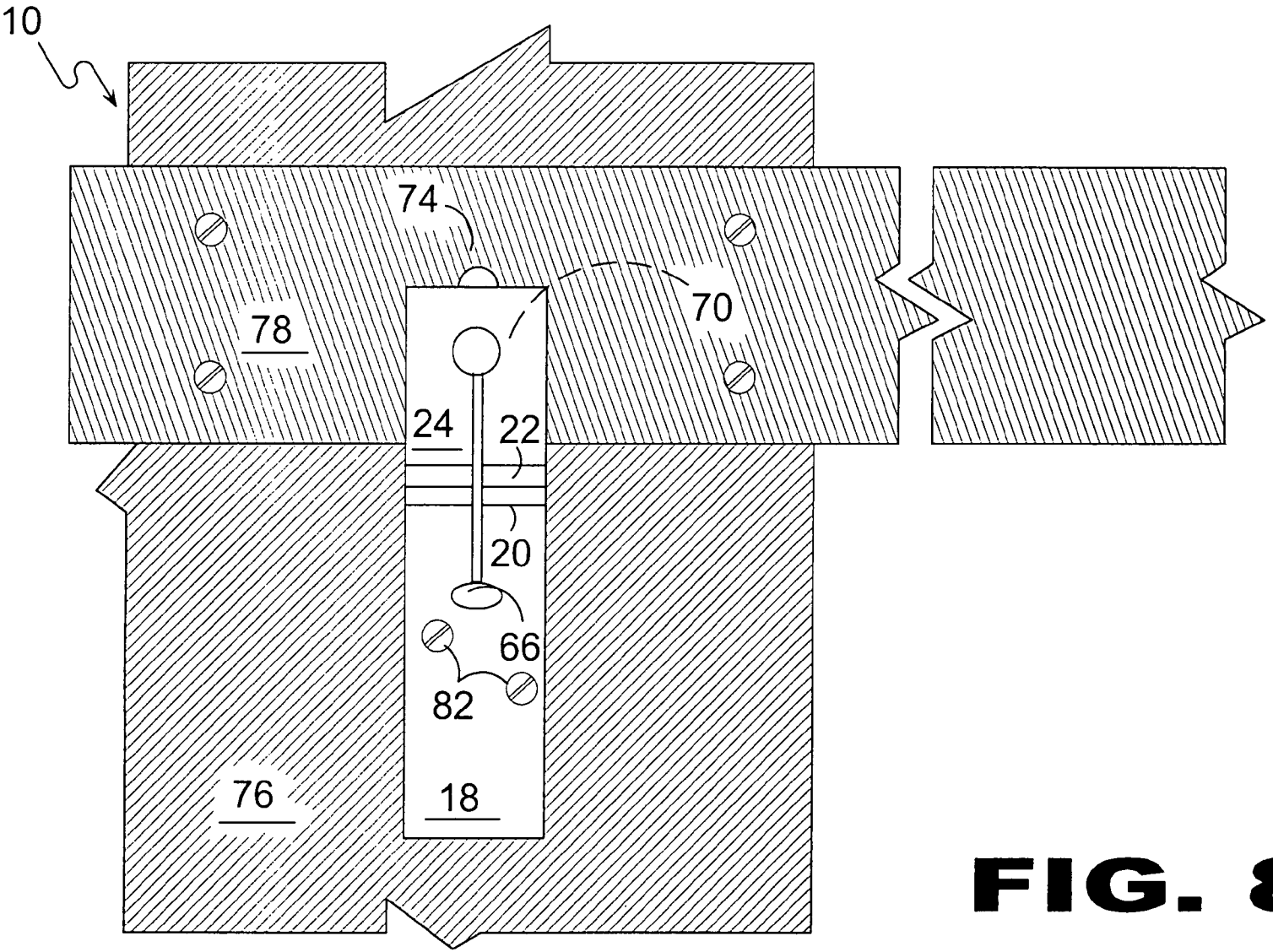
FIG. 8 is a front view of the leveling clamp in use.

FIG. 8 is a front view of the leveling clamp in use. The present invention is a temporary support tool 10 for use in construction whereby a horizontal length of dimensional lumber 78 (or ledger) will be fastened to a vertical length of dimensional lumber 76 or any surface which will require the use of a ledger; concrete, cinder block, drywall or plywood surfaces. The apparatus provides a secure and level platform 22 for the ledger 78 to rest upon while it is in the process of being permanently attached to an upright 76 with any acceptable and approved method: nails, screws, lags or bolts. The support is obtained by installing two temporary screws 82 of varying length through the provided holes 44 in the mounting plate 18 the ledger 78 is then held fast 80 to the vertical member 76 by tightening the locking plate 70 of the apparatus by turning 66 the threaded adjustment screw 68 until a tight fit is made. After establishing a location where the ledger 78 is to be fastened and establishing a level position using a leveling vial 74 provided by the apparatus the installer will drive two temporary screws 82 into the mounting plate 18. The installer will then set the ledger 78 in place and tighten the adjusting bar 68, after this the installer will then proceed to make permanent attachments. After the ledger is secured the apparatus may be removed and any additional attachment fasteners that may be required may be added.

What is claimed is new and desired to be protected by Letters Patent is set forth in the appended claims:

1. A support apparatus comprising:

a) an L-shaped mounting member having conjoined flat legs at right angles to each other, one of said legs being horizontal and the other of said legs being vertical, said vertical leg being attached to a vertically extending surface of a support structure and the horizontal leg extending away from said vertically extending surface and terminating in a free end;

b) an L-shaped support member having conjoined flat arms at right angles to each other, with one arm thereof fixed to an upper surface of said horizontal leg of said mounting member and the other of said arms extending vertically upwardly being a support arm, a free end of said leg fixed to said horizontal leg of said mounting member abutting said vertically extending surface;

c) a horizontally extending threaded shaft threadedly engaging the vertically extending support arm for applying transverse pressure to a workpiece against said vertically extending surface; and d) said vertical leg of said mounting member having a plurality of apertures for releasable fastening the mounting member to said vertically extending surface for temporarily supporting said workpiece as said workpiece is permanently fastened to said support structure.

2. The apparatus as recited in claim 1, wherein a free end of said vertical support arm incorporates a level.

3. The apparatus as recited in claim 2, wherein said threaded shaft has a pressure plate fixed to one end thereof for contacting said workpiece and a handle at an opposite end of said threaded shaft for applying a torque to said threaded shaft for clamping said workpiece against said support structure.

4. A support apparatus for temporarily holding a wood workpiece against a vertical surface ova support structure while said workpiece is permanently attached to said support structure comprising:

a) an L-shaped mounting member having flat legs at right angles to each other, one of said legs being horizontal and the other of said legs being vertical, said vertical leg being attached to said vertically extending surface of said support structure and the horizontal leg extending away from said vertically extending surface and terminating in a free end;

b) an L-shaped support member having flat arms at right angles to each other, with one arm thereof fixed to an upper surface of said horizontal leg of said mounting member and the other of said arms extending vertically upwardly and being a support arm, a free end of said horizontal arm abutting said vertically extending surface;

c) a horizontally extending shaft threadedly engaging the vertically extending support arm for applying transverse pressure to said wood workpiece against said vertically extending surface while a bottom surface of said wood workpiece rests on an upper surface of said horizontal arm of said support member;

d) said vertical leg of said mounting member having a plurality of apertures for releasably fastening the mounting member to said vertically extending surface for temporarily supporting said wood workpiece as said wood workpiece is permanently fastened to said support structure; and e) the support arm of said support member having a free end with a horizontal surface, and a leveling vial mounted in said horizontal surface for positioning said support apparatus on said support structure prior to releasably fastening said the mounting member to said vertically extending surface.

* * * * *